US005108521A

United States Patent [19]

Hosoya et al.

[11] Patent Number: 5,108,521

[45] Date of Patent: Apr. 28, 1992

[54] METHOD OF MAKING NON-ORIENTED MAGNETIC STEEL STRIPS

[75] Inventors: Yoshihiro Hosoya; Akihiko Nishimoto; Toshiaki Urabe, all of Tokyo, Japan

[73] Assignee: NKK Corporation, Tokyo, Japan

[21] Appl. No.: 747,381

[22] Filed: Aug. 20, 1991

Related U.S. Application Data

[63] Continuation-in-part of Ser. No. 468.891, Jan. 23, 1990, abandoned.

[30] Foreign Application Priority Data

Feb. 21, 1989 [JP] Japan ..... 1-39214
Dec. 29, 1989 [JP] Japan ..... 1-342206

[51] Int. Cl.[5] ..... H01F 1/04
[52] U.S. Cl. ..... 148/111; 148/120
[58] Field of Search ..... 148/111, 120

[56] References Cited

U.S. PATENT DOCUMENTS 3,770,517 11/1973 Gray et al. ..... 148/111
4,306,922 12/1981 Coombs et al. ..... 148/111
4,666,534 5/1987 Miyoshi et al. ..... 148/111

*Primary Examiner*—John P. Sheehan
*Attorney, Agent, or Firm*—Nields & Lemack

[57] ABSTRACT

For enabling the manufacture of non-oriented steel strips by HDR, the amounts of AlN and MnS which precipitate on the way of HDR are decreased to such a level that they do not affect the magnetic properties by regulating the Al and S contents, and further unavoidable precipitating nitrides are precipitated as coarse BN. With regard to the steel composition, the amounts of C, Si and P are not only regulated, but also the amounts of Mn, Al, S and N are regulated from the above standpoint, and a proper amount of B is added if required. In addition, in regard to treatment conditions, in order to secure necessary finishing and coiling temperatures, the lower limit of the slab temperature at the starting time of HDR is specified. Moreover, to secure precipitation of BN and recrystallization of a ferrite structure, the lower limits of the finishing and coiling temperatures are specified. Furthermore, to secure the magnetic properties after cold rolling, the strips are finally continuously annealed at the determined temperature.

6 Claims, 1 Drawing Sheet

Remarks: [*: difference between HDR products and ordinary HCR products on $W_{15/50}$]

Remarks: [*: difference between HDR products and ordinary HCR products on $W_{15/50}$]

METHOD OF MAKING NON-ORIENTED MAGNETIC STEEL STRIPS

This application is a continuation-in-part of application Ser. No. 07/468,891, filed Jan. 23, 1990 now abandoned.

TECHNICAL FIELD

The present invention relates to a method of making non-oriented magnetic steel strips through a hot direct rolling (hereinafter referred to as "HDR").

Generally, HDR means, strictly speaking, a rolling method in which a cast slab is directly hot-rolled without heating. But the explanation of the invention also includes in HDR in a broad sense such a process that the cast slab is reheated before its temperature goes down remarkably and is hot-rolled (hot slab—reheating—rolling).

BACKGROUND OF THE INVENTION

As important factors governing properties of magnetic steel strips, there are amounts, sizes, morphology and distribution of AlN and MnS which precipitate in steel. They do not only influence the magnetic properties of final products but also play important roles for the formation of the microstructure of the steel strips during a series of processing.

In the case of grain oriented silicon steel strips, the precipitates such as AlN and MnS are effectively utilized as inhibitors which control a secondary recrystallization. However, with respect to the non-oriented silicon steel strips, there have been disclosed technologies to make the precipitates harmless, as follows:

1. The slab is heated at low temperature so as to check resolution of AlN or MnS (e.g. Patent Publication No. 50-35885).

2. The amounts of S and O are decreased which produce fine precipitates of non-metallic inclusions (e.g. Patent Publication No. 56-22931).

3. Ca and REM are added to control morphology of sulfide inclusions (e.g. Patent Publications No. 58-17248 and No. 58-17249).

4. The steel strip is coiled at ultra high temperature after hot rolling so as to cause a self-annealing thereof, so that AlN is coarsened by self-annealing effect (Patent Publication No. 57-43132).

Most of these technologies are based on the premise of the conventional processes which consist of slab reheating and hot rolling. However, taking into consideration the employment of direct rolling, which is regarded as promising in terms of energy- and process-savings, the above technologies alone are insufficient to obtain the excellent magnetic properties, because in the direct rolling, AlN or MnS finely precipitate in steel during the hot rolling process.

Therefore from the viewpoint of solving the above problems, as a method of coarsening AlN in HDR, technologies have been proposed to coarsen AlN by briefly heating the slab on the way of HDR as taught in Patent Publications No. 56-18045, No. 56-33451 and Laid-Open No. 58-123825. However, these techniques cause non-uniform precipitation of AlN in the thickness direction of the slab. Therefore those methods are not always sufficient for manufacturing the magnetic steel strip of which uniformity of the property is important.

SUMMARY OF THE INVENTION

The present invention has been developed in view of the conventional problems as mentioned above. In order to realize the HDR technique in a process of manufacturing the magnetic steel strip, the invention makes it possible to control the precipitation of AlN and MnS in HDR, which has been hitherto a difficult problem, by means of a claimed original component designation and a claimed prescription of treatment conditions. That is, the essence of the invention is to decrease the amounts of AlN and MnS precipitating during HDR to a level that they do not affect magnetic properties by regulating the Al and S contents and also to have inevitably precipitating nitrides as coarse BN precipitates.

A first invention comprises the steps of starting a hot rolling on a continuously cast slab which is composed of C: not more than 0.02 wt %, Si: 0.1 to 1.5 wt %, Mn: 0.1 to 1.0 wt %, S: not more than 0.005 wt %, Al: not more than 0.002 wt %, P: not more than 0.1 wt %, N: not more than 0.0030 wt %, the balance being Fe and unavoidable impurities, at a state while the surface temperature of the slab has not become lower than 1000° C. or at a state that the slab is reheated to not lower than 1000° C. before the surface temperature of the slab becomes lower than 600° C. and is then soaked at the temperature of not lower than 1000° C. for not less than 10 min, coiling at a temperature which is not lower than 650° C. following accomplishing the hot-rolling at finishing temperature which is not lower than 820° C., subsequently performing a one-time cold-rolling to said hot rolled steel strip, or performing cold rollings of more than once interposing process annealing(s) therebetween, and thereafter continuously annealing at a range between temperatures of 750° and 950° C.

A second invention comprises carrying out a treatment under the same condition as above mentioned to a continuously cast slab which is composed of C: not more than 0.02 wt %, Si: 0.1 to 1.5 wt %, Mn: 0.1 to 1.0 wt %, S: not more than 0.005 wt %, Al: not more than 0.005 wt %, P: not more than 0.1 wt %, N: not more than 0.0030 wt %, B: 0.8 to 2.0 in B(wt %)/N(wt %), the balance being Fe and unavoidable impurities.

There are two embodiments of Applicants' invention. One embodiment relates to non B-addition steels; as to these non B-addition steels, the upper limit of Al is 0.002%. The other embodiment relates to B-addition steels; as to these B-addition steels, the upper limit of Al is 0.005%. In Table 1, Steels Nos. 1, 2, 7, 13, 16, 17, 23 and 24 are non B-addition steels. The remaining steels in Table 1 are B-addition steels. As to the latter, the upper limit of Al is 0.005%, and so the lack of an asterisk in the "Sol.Al" column for Steels Nos. 9 and 20 is correct; it is not the Al content which carries these steels outside the scope of the claimed invention. However, in Steel No. 9 of Table 1 the high sulfur content carries the steel outside the scope of the claim; in Steel No. 20 the low manganese content carries the steel outside the scope of the claim.

The present invention includes two alternative methods in carrying out the process from the slab casting until the hot rolling, as follows:

Method 1) The cast slab is directly rolled, while maintaining the temperature of not lower than 1000° C.

Method 2) Even if the cast slab becomes lower than 1000° C., the temperature is not allowed to be less than 600° C., and from this temperature range (600≦temp- .<1000° C.), the cast slab is reheated to a temperature of not lower than 1000° C. and rolled.

Thus, the steel is *not* cooled to *any* temperature range. In other words, in the above method (1), the temperature of the steel never becomes lower than 1000° C. from the casting until the hot-rolling of the slab, and in the method (2), the temperature of the steel may be allowed to decrease down to 600° C.

After having been cast, the slab is never cooled to be lower than 600° C., and the hot-rolling is never started from a temperature of less than 1000° C.

"Continuous annealing" is performed on the finally cold-rolled steel plate, and should be distinguished from the intermediate annealings to be done in between the cold-rollings when a plurality of intermediate cold rolling steps are employed. In summary, the processes are as follows:

Cold-rolling (including the intermediate annealings in between the cold rollings when a plurality of cold-rolling steps are employed)

↓

Final continuous annealing

DETAILED DESCRIPTION OF THE INVENTION

Figure 1:
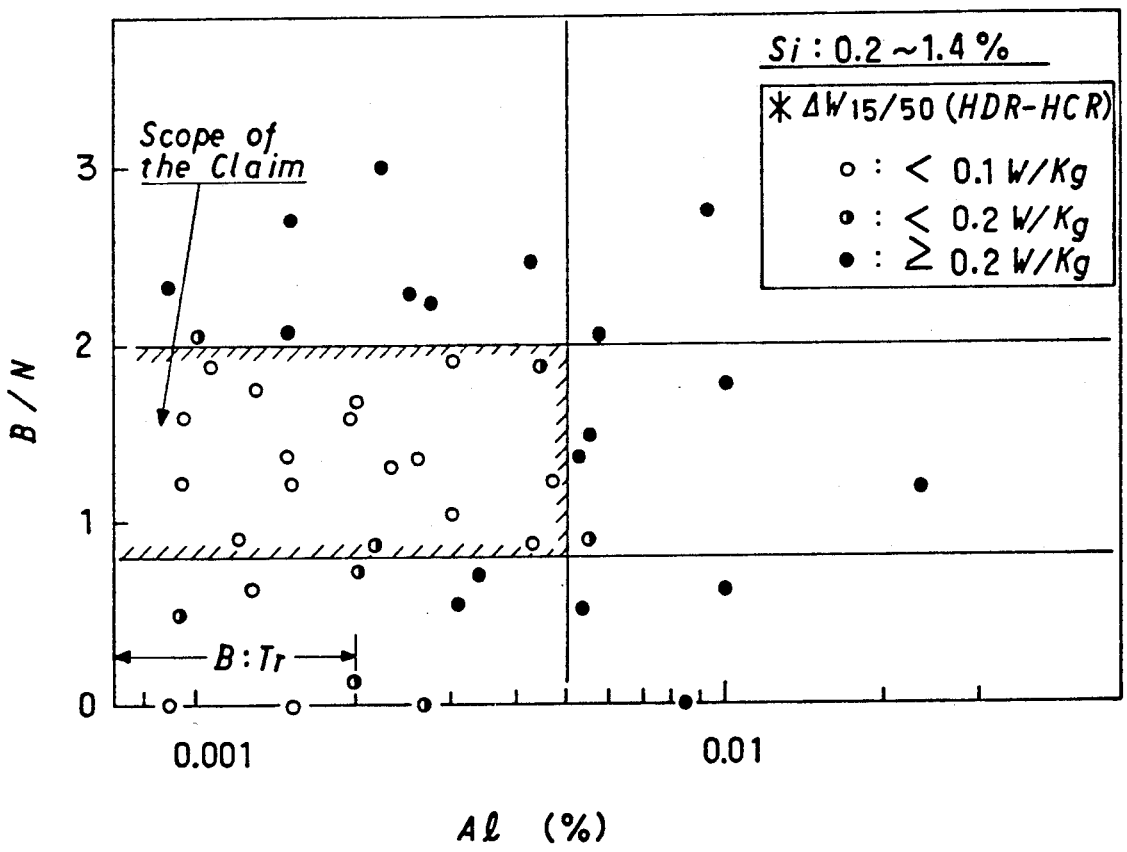
FIG. 1 shows a region of B/N where a low core loss value is obtained in a relationship with Al content.

The present invention will be explained in detail together with limiting reasons thereof.

The limiting reasons of the steel composition will be referred to.

C: The invention premises that a steel contains not more than 0.02 wt% at a steel making stage. In particular, in terms of magnetic aging, it is desirable that C is less than 0.005 wt% in the final products. For this purpose, a decarburization is carried out either by a vacuum-degassing treatment in the steelmaking or by a decarburization annealing during final annealing stage.

Si: This is an effective element for decreasing a core loss value in the magnetic steel strip. In high-grade products where the low core loss value is essential, not less than 2 wt% Si is added. However, with an increase in Si content, recrystallization of ferrite does not sufficiently proceed during hot rolling and subsequent coiling. Thus, the annealing to the hot rolled band is required for obtaining desired properties. In the invention, however, the upper limit of Si is specified at 1.5 wt% for the purpose of supplying low-grade products without annealing hot rolled strips more economically. On the other hand, for the sake of decreasing the core loss value essential for manufacturing the magnetic steel strip, the lower limit of Si is 0.1 wt%.

Mn: When manufacturing the magnetic steel strip, Mn precipitates S as MnS during HDR. Therefore the amount of Mn is very important from the stand point of its size control. To precipitate S sufficiently in the steel, the invention specifies the lower limit of Mn at 0.1 wt% and the upper limit at 1.0 wt% as the limit not exerting bad influences on the magnetic properties.

S: Aiming at regulating a total amount of MnS precipitation during HDR, S content is specified at not more than 0.005 wt%.

Al: This is an important element in the invention. Contrary to the conventional technologies which aim at controlling the size and distribution of AlN precipitates, the invention decreases Al extremely, aiming at lowering AlN to the level where it does not arouse problems over the magnetic properties. Thus, Al is regulated to not more than 0.002 wt%. Nevertheless, in a case of B addition as later mentioned, the excellent properties can be obtained by specifying Al at not more than 0.005 wt% as shown in FIG. 1.

P: This is a cheap and effective element to decrease the core loss of a low Si magnetic steel strip. However, much addition not only makes the strip hard but also causes the slab cracking. Therefore its upper limit is 0.1 wt%.

N: This precipitates as fine AlN in the hot rolling process, and inhibits grain growth of ferrite not only in the hot rolled strip but in the cold rolled strip during final annealing. The invention is to check the precipitation of AlN as much as possible and to possibly precipitate it as BN by B addition as later stated and specifies the upper limit of N at 0.0030 wt% to regulate the amounts of precipitations in both AlN and BN.

B: This is one of the most important elements in the invention. Particularly, by regulating the Al amount, B extremely decreases the amount of AlN which precipitates during HDR, and also makes N, which is unavoidably contained, precipitate as BN. FIG. 1 illustrates that a region of B/N, in which the low core loss value is obtained ($\Delta W_{15/50}$ is a difference in the core loss value between HDR products and the conventional HCR products), in relation with the Al content. When Al is not more than 0.005 wt%, the low core loss value almost equivalent to that of the ordinary HCR products is obtained in the scope of B/N being 0.8 to 2.0. Thus, in the invention, B is added within the scope of B/N of 0.8 to 2.0.

In the present invention, the continuously cast slab having the composition as mentioned above is directly rolled, and a slab temperature (slab surface temperature, hereinafter referred to the same) at which the direct rolling starts is specified at not less than 1000° C. Because if the starting temperature of the rolling is lower than 1000° C., it is difficult to secure the finishing and coiling temperature specified by the invention, and insufficient to provide strain-induced precipitation in the hot rolling process as well as BN growth after the coiling. Moreover in the invention, if the slab temperature becomes lower than 1000° C. after casting, the lower limit is specified at 600° C., and it is possible to perform the rolling by reheating the slab to not lower than 1000° C. from a temperature range of not lower than 600° C., so that the desired properties may be obtained. When the slab temperature decreases lower than 600° C., it is difficult to uniformly heat the slab into its interior by a short-time reheating treatment, and a slab soaking such as the conventional heat treatment becomes inevitable. In short, it spoils merits of the invention from an economical viewpoint. In addition, with respect to a soaking time when reheating the slab, the required properties may be obtained if securing not less than 10 minutes. Nevertheless if the soaking time is too long, it is not a good policy in term of the economy. That is, the soaking for not more than 40 min is preferable.

In the hot rolling, the finish rolling is performed at the temperature of not lower than 820° C. and the coiling is done not lower than 650° C. to secure the coiling temperature. In order to have the ferrite structure of hot rolled strip recrystallize sufficiently after coiling, in addition to the precipitation of BN, the invention stipulates a precondition that the strip is coiled at not lower than 650° C.

The hot rolled steel strip is, according to the conventional process, continuously annealed at the temperature of 750° to 950° C. after cold rolling of once or more than once interposing the process annealing.

The above mentioned process annealing is usually performed at the soaking temperature of around 750° to 900° C. As to this annealing practice, either a coil annealing or a continuous annealing will do.

The final annealing is carried out by the continuous annealing. If the heating temperature is lower than 750° C., the grain growth is insufficient. Contrary, if it is exceeds 950° C., ferrite grains grow excessively, resulting in a core loss increase.

EXAMPLE 1

The continuously cast slabs having the chemical compositions of Nos. 1, 3 and 18 shown in Table 1 were subjected to HDR (to thickness: 2.0 mm) under the condition shown in Table 2. Then the hot rolled strips were pickled and cold-rolled to a thickness of 0.5 mm. The final annealing was performed to the strip in the continuously annealing line. The obtained magnetic properties of the strips are shown in Table 2.

EXAMPLE 2

The continuously cast slabs having the compositions of Nos. 8 and 18 shown in Table 1 were reheated and hot-rolled to a thickness of 2.0 mm under the conditions shown in Table 3. The hot rolled strips were pickled and cold-rolled to a thickness of 0.5 mm, and the final annealing was applied to the strips in the continous annealing line. The obtained magnetic properties of the strips are shown in Table 3.

EXAMPLE 3

The continuously cast slabs having the compositions shown in Table 1 were directly hot rolled without introducing into the heating furnace at the surface temperature of not lower than 1000° C. and were hot-rolled to a thickness of 2.0 mm at the finishing temperature between 820° and 870° C., and were coiled at the temperature of 680° to 710° C. and pickled, and cold-rolled to a thickness of 0.5 mm. The obtained magnetic properties of the strips by the continuous annealing at the temperatures shown in Table 4-a and 4-b are shown.

TABLE 1

| NO. | | C | Si | Mn | P | S | Sol.Al | N | B | (wt %) B/N |
|---|---|---|---|---|---|---|---|---|---|---|
| 1 | I | 0.0029 | 0.24 | 0.23 | 0.014 | 0.002 | 0.001 | 0.0017 | — | 0 |
| 2 | C | 0.0031 | 0.25 | 0.25 | 0.015 | 0.002 | 0.003* | 0.0019 | — | 0 |
| 3 | I | 0.0032 | 0.23 | 0.23 | 0.012 | 0.002 | 0.002 | 0.0018 | 0.0030 | 1.67 |
| 4 | C | 0.0025 | 0.25 | 0.19 | 0.020 | 0.003 | 0.015* | 0.0020 | 0.0025 | 1.25 |
| 5 | C | 0.0027 | 0.47 | 0.28 | 0.017 | 0.009* | Tr | 0.0021 | 0.0031 | 1.48 |
| 6 | I | 0.0029 | 0.47 | 0.31 | 0.015 | 0.002 | 0.001 | 0.0015 | 0.0018 | 1.20 |
| 7 | C | 0.0029 | 0.46 | 0.30 | 0.020 | 0.003 | 0.004* | 0.0020 | — | 0 |
| 8 | I | 0.0030 | 0.74 | 0.21 | 0.023 | 0.004 | 0.002 | 0.0024 | 0.0031 | 1.29 |
| 9 | C | 0.0031 | 0.77 | 0.22 | 0.015 | 0.008* | 0.003 | 0.0018 | 0.0025 | 1.39 |
| 10 | C | 0.0027 | 0.80 | 0.20 | 0.019 | 0.003 | 0.009* | 0.0015 | 0.0024 | 1.60 |
| 11 | C | 0.0030 | 0.75 | 0.19 | 0.021 | 0.002 | 0.002 | 0.0045 | 0.0030 | 0.67* |
| 12 | C | 0.0025 | 0.75 | 0.22 | 0.022 | 0.002 | 0.002 | 0.0020 | 0.0042 | 2.10* |
| 13 | C | 0.0024 | 0.74 | 0.20 | 0.017 | 0.002 | 0.008* | 0.0021 | — | 0 |
| 14 | C | 0.0024 | 0.75 | 0.24 | 0.023 | 0.003 | 0.001 | 0.0019 | 0.007 | 0.37* |
| 15 | C | 0.0026 | 0.76 | 0.23 | 0.019 | 0.003 | 0.001 | 0.0024 | 0.0015 | 0.63* |
| 16 | C | 0.0027 | 1.35 | 0.19 | 0.024 | 0.002 | 0.0028* | 0.0023 | — | 0 |
| 17 | I | 0.0028 | 1.36 | 0.20 | 0.021 | 0.002 | 0.0015 | 0.0020 | — | 0 |
| 18 | I | 0.0028 | 1.34 | 0.25 | 0.025 | 0.002 | 0.002 | 0.0022 | 0.0030 | 1.36 |
| 19 | C | 0.0031 | 1.34 | 0.26 | 0.023 | 0.003 | 0.012* | 0.0019 | 0.0031 | 1.63 |
| 20 | C | 0.0023 | 1.35 | 0.06* | 0.022 | 0.004 | 0.003 | 0.0017 | 0.0028 | 1.65 |
| 21 | I | 0.0025 | 1.33 | 0.24 | 0.017 | 0.004 | 0.001 | 0.0016 | 0.0030 | 1.88 |
| 22 | C | 0.0027 | 2.05* | 0.23 | 0.019 | 0.002 | 0.002 | 0.0017 | 0.0020 | 1.18 |
| 23 | I | 0.0032 | 0.16 | 0.45 | 0.025 | 0.004 | 0.001 | 0.0020 | — | 0 |
| 24 | C | 0.0034 | 0.17 | 0.43 | 0.024 | 0.004 | 0.005* | 0.0021 | — | 0 |
| 25 | I | 0.0033 | 0.17 | 0.42 | 0.025 | 0.005 | 0.001 | 0.0015 | 0.0025 | 1.61 |

I: Inventive steels
C: Comparative steels
*Out of claimed scope

TABLE 2

| No. | A | B (°C.) | D (°C.) | E (°C.) | F (°C.) | G $B_{50}$ (T) | G $W_{15/50}$ (w/kg) |
|---|---|---|---|---|---|---|---|
| 1 | C | 1120 | 830 | 700 | 720* | 1.77 | 8.15 |
| | I | 1120 | 830 | 700 | 760 | 1.82 | 7.45 |
| | I | 1120 | 850 | 730 | 760 | 1.83 | 7.25 |
| | I | 1100 | 840 | 730 | 800 | 1.80 | 7.20 |
| | C | 1100 | 830 | 630* | 800 | 1.75 | 7.95 |
| | C | 960* | 770* | 730 | 800 | 1.73 | 7.76 |
| 3 | I | 1100 | 850 | 720 | 770 | 1.79 | 7.35 |
| | C | 1100 | 790* | 720 | 770 | 1.74 | 7.56 |
| | I | 1100 | 850 | 700 | 800 | 1.78 | 7.26 |
| | C | 1100 | 850 | 620* | 800 | 1.75 | 8.15 |
| | C | 950* | 790* | 720 | 800 | 1.74 | 7.65 |
| 18 | I | 1100 | 820 | 720 | 820 | 1.70 | 4.73 |
| | I | 1120 | 820 | 740 | 820 | 1.71 | 4.69 |
| | I | 1120 | 850 | 760 | 850 | 1.73 | 4.65 |
| | C | 990* | 820 | 750 | 850 | 1.71 | 5.03 |
| | C | 1100 | 780* | 710 | 850 | 1.70 | 5.27 |
| | C | 1120 | 850 | 620* | 850 | 1.68 | 5.85 |
| | I | 1150 | 870 | 780 | 850 | 1.74 | 4.55 |
| 23 | I | 1120 | 860 | 680 | 760 | 1.82 | 7.63 |
| | C | 1120 | 860 | 600* | 760 | 1.76 | 8.15 |

TABLE 2-continued

| No. | A | B (°C.) | D (°C.) | E (°C.) | F (°C.) | G $B_{50}$ (T) | G $W_{15/50}$ (w/kg) |
|---|---|---|---|---|---|---|---|
| | C | 1100 | 800* | 700 | 760 | 1.78 | 8.09 |

A: Process.
B: HDR starting temperature
C: Comparative condition.
D: Finishing temperature
E: Coiling temperature.
F: Final annealing temperature
I: Inventive condition;
*Out of claimed condition
G: Magnetic properties

TABLE 3

| No. | A | H N (°C.) | H J (°C.) | H K (min) | M L (°C.) | M D (°C.) | M E (°C.) | F (°C.) | G $B_{50}$ (T) | G $W_{15/50}$ (w/kg) |
|---|---|---|---|---|---|---|---|---|---|---|
| 8 | I | 700 | 1100 | 30 | 1050 | 860 | 680 | 760 | 1.77 | 5.70 |
| | I | 700 | 1140 | 60 | 1070 | 860 | 700 | 780 | 1.78 | 5.67 |
| | C | 400* | 1100 | 30 | 1050 | 860 | 680 | 780 | 1.73 | 5.70 |
| | I | 700 | 1100 | 30 | 1050 | 860 | 680 | 800 | 1.77 | 5.52 |
| | C | 400* | 1100 | 30 | 1050 | 860 | 680 | 800 | 1.74 | 5.73 |
| | C | 700 | 1120 | 5* | 1050 | 870 | 700 | 800 | 1.73 | 6.15 |
| | C | 600 | 1120 | 60 | 960* | 810 | 670 | 800 | 1.70 | 6.45 |
| 18 | I | 650 | 1150 | 60 | 1070 | 840 | 700 | 800 | 1.75 | 4.50 |
| | I | 700 | 1100 | 60 | 1060 | 830 | 740 | 800 | 1.77 | 4.05 |
| | C | 700 | 950* | 60 | 1060 | 840 | 700 | 800 | 1.69 | 5.21 |
| | I | 650 | 1150 | 60 | 1070 | 840 | 700 | 850 | 1.74 | 4.47 |
| | C | 300* | 1150 | 60 | 1070 | 840 | 710 | 850 | 1.71 | 4.61 |
| | C | 700 | 950* | 60 | 1070 | 840 | 680 | 850 | 1.68 | 5.10 |
| | C | 700 | 1100 | 5* | 1060 | 830 | 700 | 850 | 1.67 | 5.15 |

A: Process;
C: Comparative condition;
D: Finishing temperature
E: Coiling temperature.
F: Final annealing temperature;
G: Magnetic properties
H: Slab reheating condition;
I: Inventive condition
J: Reheating temperature;
K: Soaking time.
L: Roll starting temperature
*Out of claimed condition;
M: Hot rolling condition.
N: Reheat starting temperature

TABLE 4

| No. | F (°C.) | G $B_{50}$ (T) | G $W_{15/50}$ (w/kg) |
|---|---|---|---|
| 1 | 760 | 1.81 | 7.35 |
| | 800 | 1.80 | 7.20 |
| 2 | 760 | 1.75 | 7.45 |
| | 800 | 1.75 | 7.23 |
| 3 | 760 | 1.80 | 7.29 |
| | 800 | 1.79 | 7.25 |
| 4 | 760 | 1.75 | 7.90 |
| | 800 | 1.74 | 7.86 |
| 5 | 760 | 1.72 | 8.12 |
| | 800 | 1.72 | 8.01 |
| 6 | 760 | 1.77 | 7.20 |
| | 800 | 1.75 | 7.02 |
| 7 | 760 | 1.72 | 7.55 |
| | 800 | 1.72 | 7.25 |
| 8 | 800 | 1.77 | 5.82 |
| | 850 | 1.76 | 5.73 |
| 9 | 800 | 1.75 | 6.65 |
| | 850 | 1.74 | 6.54 |
| 10 | 800 | 1.76 | 6.46 |
| | 850 | 1.75 | 6.32 |
| 11 | 800 | 1.73 | 6.60 |
| | 850 | 1.73 | 6.54 |
| 12 | 800 | 1.69 | 6.89 |
| | 850 | 1.70 | 6.85 |
| 13 | 800 | 1.76 | 6.45 |
| | 850 | 1.75 | 6.24 |
| 14 | 800 | 1.77 | 6.00 |
| | 850 | 1.76 | 5.94 |

TABLE 4-continued

| No. | F (°C.) | G $B_{50}$ (T) | G $W_{15/50}$ (w/kg) |
|---|---|---|---|
| 15 | 800 | 1.73 | 5.99 |
| | 850 | 1.72 | 5.89 |
| 16 | 840 | 1.71 | 4.78 |
| | 880 | 1.70 | 4.65 |
| 17 | 840 | 1.75 | 4.60 |
| | 880 | 1.73 | 4.50 |
| 18 | 840 | 1.74 | 4.72 |
| | 880 | 1.73 | 4.64 |
| 19 | 840 | 1.70 | 5.23 |
| | 880 | 1.70 | 5.01 |
| 20 | 840 | 1.69 | 5.45 |
| | 880 | 1.69 | 5.32 |
| 21 | 840 | 1.75 | 4.62 |
| | 880 | 1.75 | 4.57 |
| 22 | 880 | 1.63 | 4.15 |
| | 920 | 1.63 | 3.95 |
| 23 | 760 | 1.82 | 7.63 |
| | 780 | 1.81 | 7.59 |
| 24 | 760 | 1.77 | 8.30 |
| | 780 | 1.75 | 8.00 |
| 25 | 760 | 1.81 | 7.70 |
| | 780 | 1.83 | 7.50 |

F: Final annealing temperature
G: Magnetic properties

We claim:

1. A method of manufacturing non-oriented magentic steel strips, comprising the steps of starting a hot rolling on a continuously cast slab which is composed of C: not more than 0.02 wt %, Si: 0.1 to 1.5 wt %, Mn: 0.1 to 1.0 wt %, S: not more than 0.0050 wt %, Al: not more than 0.002 wt %, P: not more than 0.1 wt %, N: not more than 0.0030 wt %, the balance being Fe and unavoidable impurities, at a state while the surface temperature of the slab has not become lower than 1000° C., or at a state that the slab is reheated to not lower than 1000° C. before the surface temperature of the slab becomes lower than 600° C. and is then soaked at the temperature of not lower than 1000° C. for not less than 10 min, coiling at a temperature which is not lower than 650° C.

following accomplishing the hot-rolling at finishing temperature which is not lower than 820° C., subsequently performing a one-time cold-rolling to said hot rolled steel strip, or performing cold rollings of more than once interposing process annealing(s) therebetween, and thereafter continuously annealing at a range between temperatures of 750° and 950° C.

2. A method of manufacturing non-oriented magnetic steel strips, comprising the steps of starting a hot rolling on a continuously cast slab which is composed of C: less than 0.005 wt %, Si: 0.1 to 1.5 wt %, Mn: 0.1 to 1.0 wt %, S: not more than 0.005 wt %, Al: not more than 0.002 wt %, P: not more than 0.1 wt %, N: not more than 0.0030 wt %. the balance being Fe and unavoidable impurities, at a state while the surface temperature of the slab has not become lower than 1000° C., or at a state that the slab is reheated to not lower than 1000° C. before the surface temperature of the slab becomes lower than 600° C. and is then soaked at the temperture of not lower than 1000° C. for not less than 10 min, coiling at a temperature which is not lower than 650° C. following accomplishing the hot-rolling at finishing temperature which is not lower than 820° C., subsequently performing a one-time cold-rolling to said hot-rolled steel strip, or performing cold rollings of more than once interposing process annealing(s) therebetween, and thereafter continuously annealing at a range between temperatures of 750° and 950° C.

3. A method of manufacturing non-oriented magnetic steel strips, comprising the steps of starting a hot rolling on a continuously cast slab which is composed of C: not more than 0.02 w %, Si: 0.1 to 1.5 wt %, Mn: 0.1 to 1.0 wt %, S: not more than 0.005 wt %, Al: not more than 0.002 wt %, P: not more than 0.1 wt %, N: not more than 0.0030 wt %, the balance being Fe and unavoidable impurities, at a state while the surface temperature of the slab has not become lower than 1000° C., or at a state that the slab is reheated to not lower than 1000° C. before the surface temperature of the slab becomes lower than 600° C. and is then soaked at the temperature of not lower than 1000° C. for not less than 10 min, coiling at a temperature which is not lower than 650° C. following accomplishing the hot-rolling at finishing temperature of not less than 820° C., subsequently performing a onetime cold-rolling to said hot-rolled steel strip, or performing cold rollings of more than once interposing process annealing(s) therebetween, and thereafter continuously annealing serving as a decarburization annealing at a range between temperatures of 750° C. and 950° C., thereby to decrease the C content less than 0.005 wt %.

4. A method of manufacturing non-oriented magnetic steel strips, comprising the steps of starting a hot rolling on a continuously cast slab which is composed of C: not more than 0.02 wt %, Si: 0.1 to 1.5 wt %, Mn: 0.1 to 1.0 wt %, S: not more than 0.005 wt %, Al: not more than 0.005 wt %, P: not more than 0.1 wt %, N: not more than 0.0030 wt %, B: 0.8 to 2.0 in B(wt %)/N(wt %), the balance being Fe and unavoidable impurities, at a state while the surface temperature of the slab has not become lower than 1000° C., or at a state that the slab is reheated to not lower than 1000° C. before the surface temperature of the slab becomes lower than 600° C. and is then soaked at the temperature of not lower than 1000° C. for not less than 10 min, coiling at temperature which is not lower than 650° C. following accomplishing the rolling at finishing temperature of not less than 820° C., subsequently performing a one-time cold-rolling to said hot rolled steel strip, or performing cold-rollings of more than once interposing process annealing(s) therebetween, and thereafter continuously annealing at a range between temperatures of 750° and 950° C.

5. A method of manufacturing non-oriented magnetic steel strips, comprising the steps of starting a hot rolling on a continuously cast slab which is composed of C: less than 0.005 wt %, Si: 0.1 to 1.5 wt %, Mn: 0.1 to 1.0 wt %, S: not more than 0.005 wt %. Al: not more than 0.005 wt %, P: not more than 0.1 wt %, N: not more than 0.0030 wt %, B: 0.8 to 2.0 in B(wt %)/N(wt %), the balance being Fe and unavoidable impurities, at a state while the surface temperature of the slab has not become lower than 1000° C., or at a state that the slab is reheated not lower than 1000° C. before the surface temperature of the slab becomes lower than 600° C. and is then soaked at the temperature of not lower than 1000° C. for not less than 10 min, coiling at temperature of not less than 650° C. following accomplishing the rolling at finishing temperature of not less than 820° C., subsequently performing a one-time cold rolling to said hot rolled steel strip, or performing cold rollings of more than once interposing process annealing(s) therebetween, and thereafter continuously annealing at a range between temperatures of 750° and 950° C.

6. A method of manufacturing non-oriented magnetic steel strips, comprising the steps of starting a hot rolling on a continuously cast slab which is composed of C: not more than 0.02 wt %, Si: 0.1 to 1.5 wt %, Mn: 0.1 to 1.0 wt %, S: not more than 0.005 wt %, Al: not more than 0.005 wt %, P: not more than 0.1 wt %, N: not more than 0.0030 wt %, B: 0.8 to 2.0 in B(wt %)/N(wt %), the balance being Fe and unavoidable impurities, at a state while the surface temperature of the slab has not become lower than 1000° C., or at a state that the slab is reheated to not lower than 1000° C. before the surface temperature of the slab becomes lower than 600° C. and is then soaked at the temperature of not lower than 1000° C. for not less than 10 min, coiling at temperature of not less than 650° C. following accomplishing the hot-rolling at finishing temperature of not less than 820° C., subsequently performing a one-time cold rolling to said hot rolled steel strip, or performing cold rollings of more than once interposing process annealing(s) therebetween, and thereafter continuously annealing serving as a decarburization annealing at a range between temperatures of 750° and 950° C., thereby to decrease the C content less than 0.005 wt %.

* * * * *